United States Patent [19]

Palumbo

[11] Patent Number: 4,912,889

[45] Date of Patent: Apr. 3, 1990

[54] ILLUMINATED FRAMEWORK STRUCTURES

[75] Inventor: Pacifico A. Palumbo, Forest Hills, N.Y.

[73] Assignee: Neon Modular Systems, Inc., New York, N.Y.

[21] Appl. No.: 279,347

[22] Filed: Dec. 2, 1988

[51] Int. Cl.[4] ..... E04B 1/58; A47G 29/00

[52] U.S. Cl. ..... 52/28; 52/648; 403/171; 403/176; 40/545; 362/145

[58] Field of Search ..... 52/646, 648, 28, 36; 403/171–178, 313, 219, 309, 305; 285/235; 40/545; 362/145, 32, 102, 152, 216, 190, 208

[56] References Cited

U.S. PATENT DOCUMENTS

| | | | |
|---|---|---|---|
| 3,305,254 | 2/1967 | Hopkins | 403/313 |
| 4,408,260 | 10/1983 | Miedel | 362/145 X |
| 4,471,586 | 4/1984 | Shuch et al. | 52/36 |
| 4,484,429 | 11/1984 | Stephenson | 52/648 |
| 4,569,165 | 2/1986 | Baker et al. | 52/648 X |
| 4,727,459 | 2/1988 | Palumbo | 40/545 X |
| 4,765,102 | 8/1988 | Kuchem | 52/28 |

*Primary Examiner*—Richard E. Chilcot, Jr.

*Attorney, Agent, or Firm*—Cohen, Pontani & Lieberman

[57] ABSTRACT

A framework which includes a plurality of angularly related elongated members interconnected by end connectors. At least one of the elongated members includes an elongated illumination device such as a noble gas discharge tube.

7 Claims, 3 Drawing Sheets

ILLUMINATED FRAMEWORK STRUCTURES

BACKGROUND OF THE PRESENT INVENTION

Framework structures are used in a large number of applications. Thus, for example, framework structures such as space frames may be used as display structures or as structures for supporting illumination devices or the like. Other framework structures have been employed to support cushioning and the like to form seating such as chairs, sofas and similar articles. It is also known to use framework structures such as space frames to provide a support for a large area roof that is otherwise unsupported excepting at its periphery, or as internal support for storage.

Such framework structures commonly include a plurality of elongated members, usually cylindrical in cross-section, which are interconnected at angles by connectors. It has previously been suggested to suspend from or secure to one or more of these elongated structural members an elongated illumination device such as a neon of fluorescent tube.

SUMMARY OF THE INVENTION

In the present invention a framework such as a space frame made up of angularly related elongated members that are held in their respective angular positions by suitable connectors includes as one or more of the elongated structural members an elongated illumination device such as, for example, a gas discharge tube or the like. Preferably, the gas discharge tube is enclosed in a transparent envelope to protect the otherwise fragile tube from breakage upon impact as well as to increase the tensile and compressive strength of the illuminated structural element so that it may serve its structural function as well as its illumination function.

DETAILED DESCRIPTION OF THE PREFERRED EMBODIMENT AND MODIFICATIONS

Figure 1:
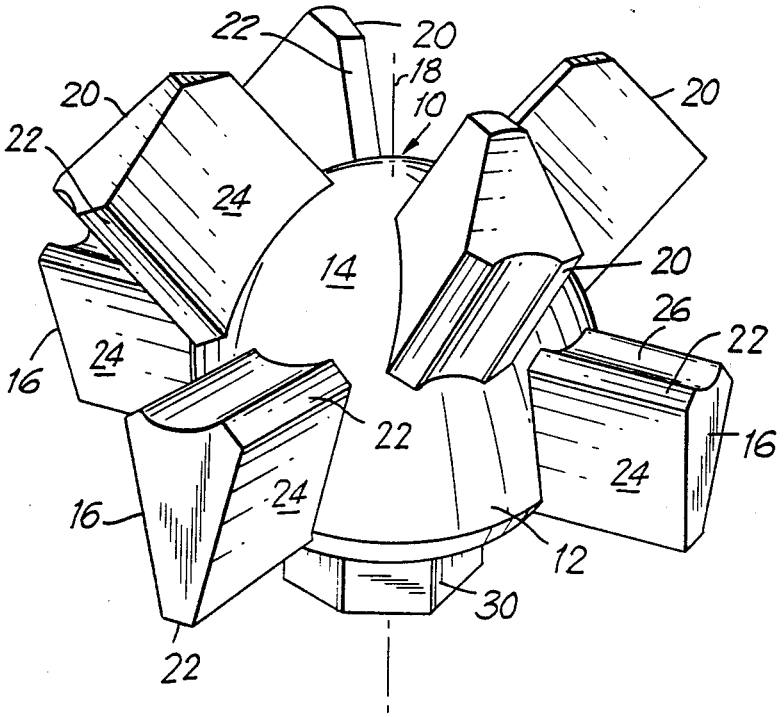
FIG. 1 is a perspective view of a presently preferred connector for use in a framework in accordance with the present invention.
Figure 2:
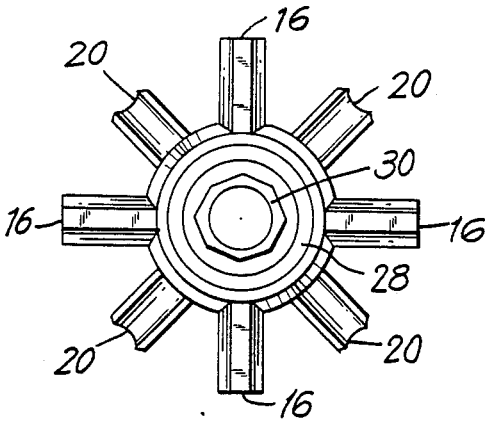
FIG. 2 is an end view of the connector shown in FIG. 1.
Figure 3:
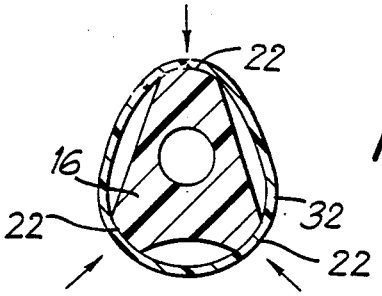
FIG. 3 is a sectional view showing the interconnection of one of the elongated structural members with one of the projections provided on the connector of FIGS. 1 and 2.

It will be recognized from the scope of the claims presented at the conclusion of the this specification that this invention is usable with any framework structure having interconnected angularly related elongated structural members secured by suitable connectors at the respective ends. However, it is presently preferred that the framework structure be the framework described in U.S. Pat. No. 4,484,429 granted to J. S. Stephenson on Nov. 27, 1984, the contents of which patent are hereby incorporated by reference in its entirety. To fulfill the enabling and best mode requirements of the present application, the invention will be described in accordance with the structure of said U.S. Pat. No. 4,484,429 by way of illustration and not by way of limitation. Likewise, it is presently preferred that the illumination device or devices employed as elongated structural members in the framework of the present invention be of the construction described and claimed in U.S. Pat. No. 4,727,459 granted to the inventor hereof, Pacifico A. Palumbo, on Feb. 23, 1988, the contents of which are hereby incorporated by reference in its entirety. However, as is true with respect to the framework, the description the particular illumination device of said patent is purely by way of illustration and is not intended to limit this invention.

Referring to FIGS. 1 through 4 of the drawings, the connector shown therein includes a connector or body part 10 having a cylindrical surface portion 12 and a part-spherical end portion 14 which adjoins the cylindrical surface portion 12. The other end portion of the body part will be referred to later. A first group of four projections 16 extend outwardly from the cylindrical surface portion 12 and are equi-angularly spaced about an axis 18 of the cylindrical surface portion 12. The projections 16 extend in a common plane which is normal to the axis 18. A second group of four projections 20 extend outwardly from the part-spherical end portion 14 of the body part 10. These projections 20 are also equi-angularly spaced about the axis 18 but are angularly staggered by 45° about this axis relative to the projections 16. Also the projections 20 extend at an angle of between 15° and 75°, and preferably at 45°, to the common plane.

Each projection 16 or 20 is of non-circular cross-section and ideally is of substantially triangular cross-section as shown. Each projection 16 or 20 has a flat 22 at the junction between each pair of sides. Each flat 22 may be slightly convex.

Each projection has two sides 24 of equal length and a side 26 of shorter length. Each side 26 has a concave recess.

The other end of the connector is provided with an axially inwardly extending annular groove 28 (see FIG. 2) which may receive the end of a tube serving as a ventricle support column. As shown this other end of the connector is also provided with an integral, hexagonal nut 30.

The connector 10 is conveniently formed from non-flexible plastics material such as that sold by I.C.I. under the Trademark "Noryl".

A plurality of such connectors can be used to connect together angularly related elongate members in the form of deformable plastic cylindrical tubes 32 (see FIG. 4) to form a space frame which may be used, for example, as a display stand. In order to locate a tube 32 on a projection 16 or 20, an end of the tube 32 is deformed, by hand pressure, is pushed over the projection and is then released. The inner wall of the tube is engaged by each of the three flats 22 of the projection as in interference (see FIG. 3).

In the above embodiment the projections are described as being of non-circular cross-section and while this is highly desirable, it is conceivable that they could be of circular cross-section.

Instead of the tubes 32, solid rods, with cylindrical deformable plastic sockets at each end, could be used.

The connectors and tubes described above could be scaled down for use as a toy or an architect's model.

If desired, the tubes 32 could be heat welded to the projections 16 or 20 in order to provide a permanent installation or, if the tubes 32 and connectors are of the same material, the tubes may be secured to the projections of the connectors by adhesive.

Moreover, the partially spherical end portion may have grooves formed therein, each groove joining a diametrically opposite pair of projections 16 and acting in conjunction with the concave recesses in the sides 26 of the associated projections 16 as a location for a cable which can run through the tubes.

Figure 4:
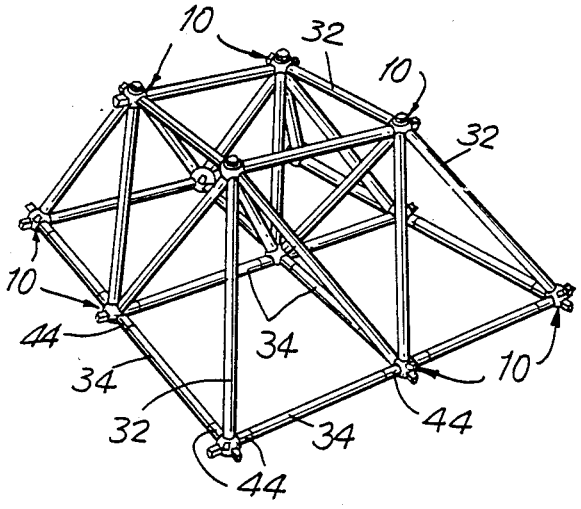
FIG. 4 is a perspective view of a framework embodying the present invention in the form of a segment of space frame.
Figure 5:
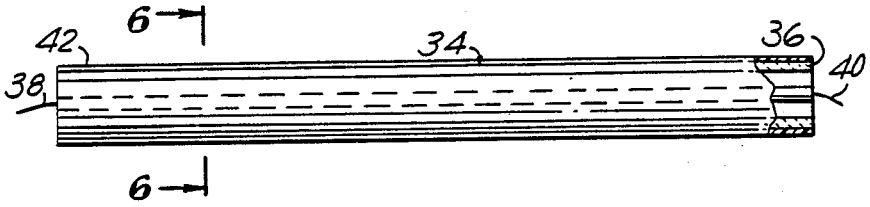
FIG. 5 is a side elevational view of a reinforced gas discharge illumination device for incorporation in a framework.
Figure 6:
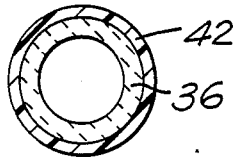
FIG. 6 is a sectional view taken along the line 66 of FIG. 5.

As may best be seen in FIG. 4, not all of the elongated structural members making up the frame are made of integral cylindrical plastic tubes 32 as previously described. Some of the elongated structural members comprise illumination devices 34 preferably in a tubular form such as a neon tube, a fluorescent tube or other kinds of elongated illumination devices. Most preferably the illumination devices 34 are reinforced noble gas discharge devices as described in said U.S. Pat. No. 4,727,459. Such a device is shown in FIG. 5 and is made up of a glass tube 36 that is sealed at both ends and has electrical leads 38 and 40 passing in sealed relation into the interior of the tube 36 for supplying energy to electrodes at opposite ends of the tube to ionize the gas and cause a gas discharge. Again as is currently preferred, but is not necessary to the invention, surrounding the gas discharge tube 36 is a transparent reinforcing tube 42 which, as shown in FIG. 5 preferably fits snugly around the glass tube 36. The tube 42 preferably of plastic serves as an envelope for the purpose of protecting the glass tube 36 from breakage as well as to give the overall elongated illumination device 34 additional tensile and compressive strength so that it will service adequately and conveniently in a space frame such as shown in FIG. 4. Preferably, although not necessarily, the illumination device 34 has an exterior diameter equal to the diameter of the structural members 32 and a similar shape, generally cylindrical. Together with end caps 40, it is preferably of the same length as tubes 32. Of course, while this is preferred, it is not absolutely necessary to the invention as will be understood in connection with the description of means for incorporating the illumination device into the frameworks of the present invention.

Figure 9:
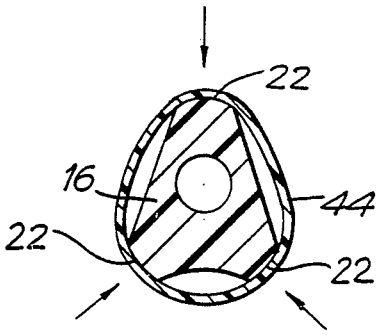
FIG. 9 is a view similar to FIG. 3 but showing one of the end caps of FIG. 7 connected to a projection on the connector shown in FIGS. 1 and 2.
Figure 7:
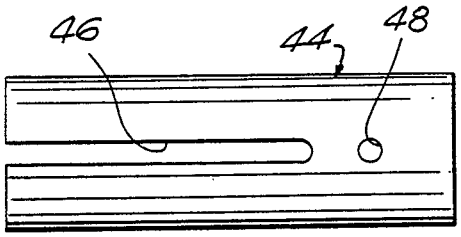
FIG. 7 is a side elevational view of an end cap for connecting the illumination device such as shown in FIG. 5 to a connector such a shown in FIGS. 1 and 2.
Figure 8:
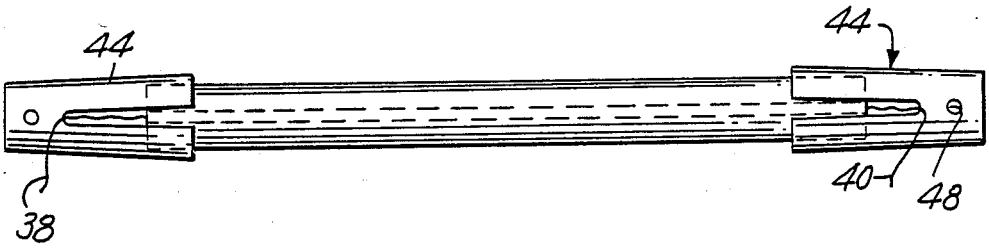
FIG. 8 is a side elevational view showing the two connectors as illustrated in FIG. 7 mounted on an illumination device such as shown in FIG. 5.

FIGS. 7 and 8 illustrate end cap 44 usable at each end of an elongated gas discharge device as shown in FIG. 5 for incorporating said gas discharge device as a structural element in a space frame as shown in FIG. 4. Preferably, although not necessarily, the end cap 44 has an exterior shape that is the sam in cross-section as the shape of the gas discharge device (and tubes 32) and of the same diameter. Moreover, the end caps are made preferably although not necessarily from a deformable material such the material from which the elongated nonilluminated structural members 32 are made, namely "Noryl". Assuming the exterior diameter of the end cap 44 is substantially equal to the exterior diameter of the illumination device then, to enable the end cap to fit over the illumination device, the material must be made deformable. This is achieved in accordance with the preferred form of the invention by providing an elongated slot 46 extending from one end of the end cap 44 to close to but spaced from the opposite end of the cap 44, whereby deformation of the end cap to receive the illumination device within it as shown in FIG. 8 made by easily achieved. If the bosses or protrusions 26 on a connector 10 are provided with some form of stud-like locking device, then a corresponding aperture 48 may be provided to achieve a locking between the end cap 44 and the connector part 26. In any event, when the connector is put around one of the protrusions 26, it will be deformed to snugly fit around said protrusion as shown in FIG. 9, which is similar to FIG. 3.

As shown in FIG. 4 by way of example only, all of the lowermost structural members are illumination devices 34. Of course, such a requirement is not within the contemplation of the invention, the invention being directed to the incorporation of at least one such illumination device 34 within the frame as an elongated member, although more than one may be included if desired. Indeed, assuming the strength of the illumination devices is adequate, as would be achieved by the use of high strength transparent plastic envelopes 42 made of, for example, polycarbonate, the entire frame could be made of such elongated illumination devices.

While the illumination device can be energized by a pair of lines 38 and 40 being fed in from one end, as shown and as currently preferred the two power leads 38 and 40 come in from opposite ends of the illumination device and may gain access to the electrodes within the illumination device by passing through respective slots 46 in opposite end caps 44 shown in FIG. 8, although other ways of energizing device 34 will readily suggest themselves to persons of orindary skill.

While the frame of the present invention has been described in its best mode as a space frame, it will be recognized that a frame in accordance with this invention may could be employed for other purposes as well. Indeed, it could be employed as a structural space frame as previously noted, or it could be employed as a supporting structure for furniture or like such as, for example, chairs, sofas and tables. In such structure, one or more of the elongated structural elements making up the frame for the furniture could be an illuminated element such as that shown in FIGS. 5 through 8.

While the present invention has been described in connection with a particular kind of framework, namely the framework described in U.S. Pat. No. 4,484,429 and incorporating a particular of illumination device, namely the illumination device such as shown in U.S. Pat. No. 4,727,459, both of which patented structures are presently preferred, it will be understood that the invention is substantially broader in concept than those preferred forms of the invention and the invention should not be limited to such previously patented structures. Indeed, the scope of this invention is defined by the scope of the claims annexed hereto.

I claim:

1. A frame comprising a plurality of elongated structural members and a plurality of connectors for connecting some of said plurality of elongated members at angles to one another, at least one of said elongated structural members being an illumination device.

2. The frame of claim 1, wherein said illumination device is a gas discharge illumination device.

3. The frame of claim 2, wherein said gas discharge illumination device is filled with a noble gas.

4. The frame of claim 2, wherein said gas discharge illumination device comprises a first tube for containing a gas and a transparent plastic tube in surrounding relation with said first tube to reinforce said discharge illumination device.

5. The frame of claim 4, wherein the first tube has no coating on the wall thereof that alters the nature of light emitted therefrom.

6. A framework structure comprising:

a plurality of connectors each including a main body portion and a plurality of angularly related projections;

a plurality of elongated members each having tubular ends for receiving one of said connector projections to angularly relate said elongated members to one another;

at least one of said elongated members comprising an elongated illumination device and a pair of tubular end caps each pair receiving a connector projection.

7. A framework structure comprising:

(1) a plurality of connectors, wherein each connector of said plurality of connectors comprises:

(a) a main body having a central axis;

(b) a first group of at least four projections extending outwardly from each said main body, and first group of at least four projections being equi-angularly spaced about said central axis, each projection of said first group of at least four projections extending from said main body in a plane normal to said central axis;

(c) a second group of at least four projections extending outwardly from each said main body, said second group of at least four projections being equiangularly spaced about said central axis, each projection of said second group of at least four projections extending at a predetermined angle of between fifteen and seventy-five degrees to said plane, each projection of said first and second groups of at least four projections being of substantially identical noncircular cross-section;

(d) an annular groove formed in each said main body, said annular grove being disposed on the opposite side of said plane from said second group at least four projections such that said annular groove selectively receives an end of a tubular member for interconnection of said main body with said tubular member; and (2) a plurality of elongate members for connecting together said plurality of connectors to form said framework structure, each elongate member of said plurality of elongate members having substantially cylindrical tubular ends selectively interconnectable with said projections of said first and second groups of at least four projections, and substantially cylindrical tubular ends being formed of a deformable material such as to form an interference fit between said substantially cylindrical tubular ends and said projections of said first and second groups of at least four projections, at least one of said elongate members including a elongate illumination device.

* * * * *